US006300893B1

(12) United States Patent
Schaff et al.

(10) Patent No.: US 6,300,893 B1
(45) Date of Patent: Oct. 9, 2001

(54) EMERGENCY PASSIVE RADAR LOCATING DEVICE

(75) Inventors: James M. Schaff, Jamestown, ND (US); Steven L. Ball, Colorado Springs, CO (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/536,505

(22) Filed: Mar. 27, 2000

(51) Int. Cl.[7] ..... H01Q 15/00
(52) U.S. Cl. ..... 342/10; 342/8
(58) Field of Search ..... 342/8, 10, 5

(56) References Cited

U.S. PATENT DOCUMENTS 3,217,325 * 11/1965 Mullin ..... 342/8
4,119,965 * 10/1978 Kaszyk ..... 342/8
4,673,934 * 6/1987 Gentry et al. ..... 342/8
4,901,081 * 2/1990 Bain, Jr. et al. ..... 342/8

* cited by examiner

*Primary Examiner*—Ian J. Lobo
(74) *Attorney, Agent, or Firm*—David Kalmbaugh

(57) ABSTRACT

An emergency passive radar locating device for use by missing persons or craft to enhance their survivability in a search and rescue operation. The emergency passive radar locating device comprises an array of eight radar corner reflectors. Each corner reflector of the emergency passive radar locating device has three radar signal reflective surfaces which are mutually perpendicular. When fully inflated the emergency passive radar locating device is spherical in shape with three mutually perpendicular toroidal flotation rings.

6 Claims, 5 Drawing Sheets

EMERGENCY PASSIVE RADAR LOCATING DEVICE

BACKGROUND OF THE INVENTION

1. Field of the Invention

The present invention relates generally to a locating device for locating missing persons, crafts and other objects in search and rescue operations. More particularly, the present invention relates to an inflatable emergency passive radar locating device which is compact, lightweight and easily adapted for use in an emergency where individuals, crafts and other objects are lost at land or at sea.

2. Description of the Prior Art

There is a need to enhance the ability for search and rescue personnel to locate missing person and craft, such as boats, land vehicles and aircraft. Missing persons, which search and rescue missions attempt to locate, include aviators, hikers, boaters, skiers and other civilian and military personnel lost in remote areas.

Active electronic devices are available such as transponders and GPS systems to assist search and rescue personnel in locating missing persons and craft. However, active electronic devices are generally very expensive and require maintenance to insure that the device is operational.

Passive locating devices are also available to assist search and rescue personnel in locating missing persons and craft. One such device is disclosed in U.S. Pat. No. 4,901,081, entitled "Elliptical Inflatable Radar Reflector" to John H. Bain, Jr. et al. The radar reflector of U.S. Pat. No. 4,901,081, which has use in search and rescue operations includes a collapsible and inflatable radar wave permeable envelope which when inflated assumes the shape of an ellipsoid. The ellipsoid envelope surrounds a radar reflective array having a number of radar wave reflectors which, when the envelope is inflated, are arranged to form a plurality of corner reflectors. The reflectors are in the shape of right multilaterals having two sides perpendicular to one another and the other sides forming obtuse angles where the apexes of these angles may provide points of attachment to the inner surface of the inflatable envelope.

While these passive locating devices are generally satisfactory for their intended purpose of locating missing persons and craft, there are deficiencies inherent in these passive locating devices which limit their use in search and rescue operations. The complexity and/or bulk (assembled or unassembled) of passive locating devices do not limit themselves to low cost, compact, lightweight applications such as use by skiers and hikers.

In addition, many passive locating devices incorporate a deployment system which fills a balloon with lighter than air gas. The balloon when fully inflated carries a radar reflector above the land or sea surface enhancing the ability of search and rescue personnel to locate missing persons or craft. These passive locating devices are often very complex, bulky and very expensive.

Other passive locating devices include foam filled inflatables which float on the water's surface, but are still complex, bulky and generally expensive.

Accordingly, there is a need for passive locating device which is relatively compact, lightweight, low cost and disposable and which may function as the primary locating device or a backup locating device.

SUMMARY OF THE INVENTION

The present invention overcomes some of the deficiencies of the prior art including those mentioned above in that it comprises a relatively simple, yet highly effective emergency passive radar locating device for use by search and rescue personnel in locating missing persons and craft.

The emergency passive radar locating device comprises an array of eight radar corner reflectors. Each corner reflector of the emergency passive radar locating device has three radar signal reflective surfaces which are mutually perpendicular. The locating device assumes the shape of a sphere when deployed. The support structure for the array of corner reflectors includes three inflatable support rings which are perpendicular to one another when the emergency passive radar locating is inflated for deployment.

DETAILED DESCRIPTION OF THE PREFERRED EMBODIMENT

Figure 1:
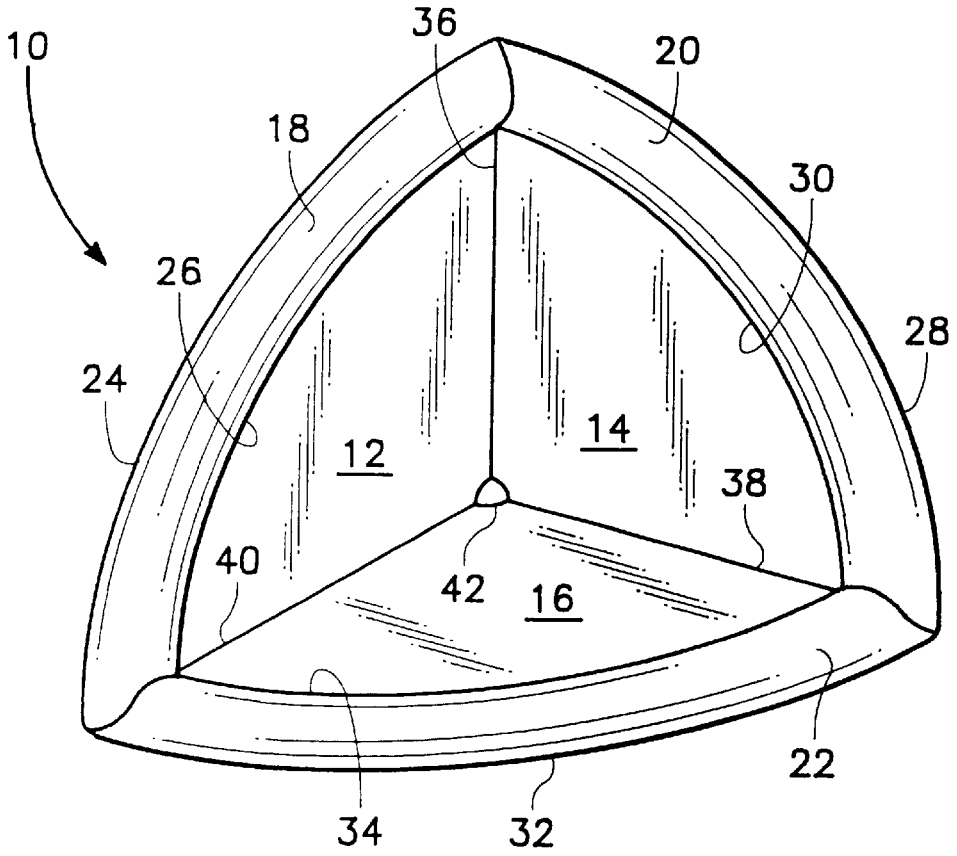
FIG. 1 is a perspective view of one corner reflector which form an emergency passive radar locating device for locating missing persons and craft.
Figure 3:
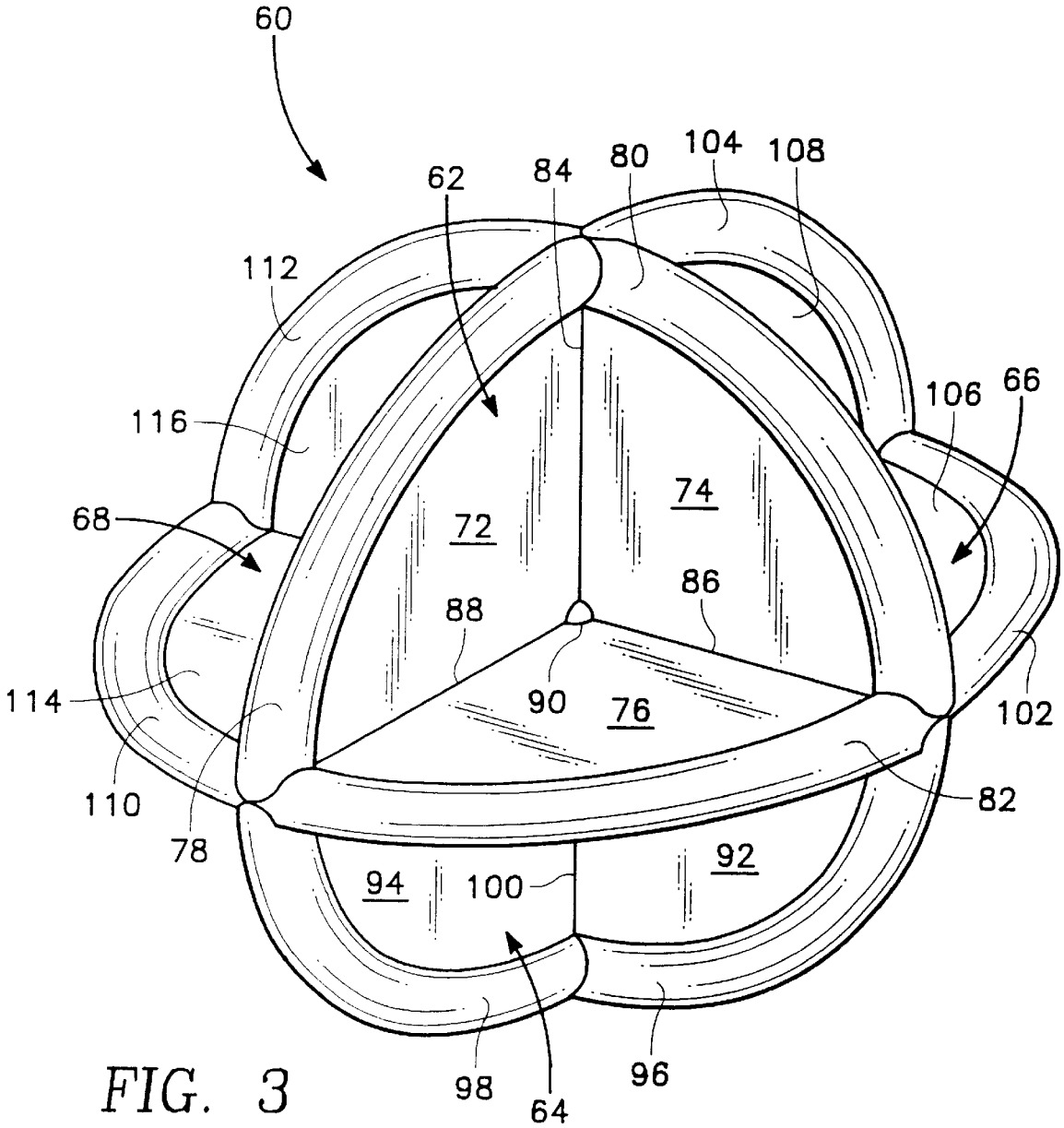
FIG. 3 illustrates an array of corner reflectors of the type depicted in FIG. 1 which are configured to form a spherical passive radar reflector comprising the preferred embodiment of the present invention.

Referring to FIGS. 1 and 3, there is shown in FIG. 3 an emergency passive radar locating device, designated generally by the reference numeral 60, which will assist search and rescue personnel in locating a missing person or craft having locating device 60 secured thereto. Emergency passive radar locating device 60 inflates and is buoyant allowing for its use at sea to locate missing persons and/or downed aircraft, ocean going vessels which are adrift and the like.

An illustrated example of how the inflatable radar reflector of the present invention (as depicted in FIG. 3) operates is as follows. A person in the water can deploy emergency passive radar locating device 60 to facilitate discovery and rescue. A reflected RF signal from locating device 60 may be received by a water borne vessel, or an airplane, or a helicopter, or by a land based radar receiver. A rescue boat may then retrieve or rescue the person lost in the water based on positional data provided by reflected signal. Likewise, a boat may be located by the reflected signal from emergency passive radar locating device 60 when one or more locating devices 60 are deployed on the boat. Thus, it can readily be seen that the object of the rescue be a man, a craft, a survivor capsule or the like, the search and rescue thereof is markedly enhanced by the deployment of locating device 60, no matter whether the lost object or person is in the water or on land.

Emergency passive radar locating device 60 comprises an array of eight trihedral corner reflectors which are configured to form a spherical passive radar reflector (FIG. 3). Four of the eight trihedral corner reflectors 62, 64, 66 and 68 are shown either partially or fully in FIG. 3.

Each trihedral corner reflector 10 (FIG. 1) of emergency passive radar locating device 60 includes three radar reflective surfaces 12, 14 and 16 (FIG. 1) fabricated from light weight, flexible radar reflector materials which can reflect radio frequency energy from a remote source. Examples of such flexible radar reflective materials include metal impregnated cloth, aluminized mylar or other metalized film material, laminated foils, metal impregnated rubber compounds. The reflective surfaces 12, 14 and 16 of corner reflector 10 are perpendicular to one another and are joined at edges 36, 38 and 40. When emergency passive radar locating device 60 is fully inflated (as shown in FIG. 3), tubes 78, 80, 82, 96, 98, 102, 104, 110 and 112 form mutually perpendicular toroids which apply a uniform radial tension to all the reflective surfaces of device 60. To illustrate, by way of example, inflating tubes 78, 80 and 82 of device 60 forms three mutually perpendicular toroids for applying uniform radial tension to the reflective surfaces 72, 74 and 76 of corner reflector 62. The radial tension, in turn, removes surface imperfections from the reflective surfaces which are very thin minor imperfections.

In the preferred embodiment of the present invention, each corner reflector 10 may be a unitary or one piece structure fabricated by vacuum-forming, die cutting or thermo forming. In the alternative, the reflective surfaces 12, 14 and 16 of emergency passive radar locating device 60 may be single panels joined at edges 36, 38 and 40.

By way of example, reflective surfaces 12 and 14 may joined by using a lightweight, small in diameter, strong and flexible string forming a seam at joint 38. Strong thread material may include Nylon, Kevler or the like. Elastic material may be used. Panels 12, 14 and 16 may also be joined or bonded at edges 36, 38 and 40 ultrasonic, cold methods or heat activated adhesives.

The inflatable toroidal support structure or framework for corner reflector 10 comprises a trio of quarter circle support members 18, 20 and 22. Reflective surfaces 12, 14 and 16 may be secured along internal curved edges 26, 30 and 34 to the inflatable toroidal support structure of corner reflector 10 by stitching which forms an internal seam, by an adhesive or by heat sealing. Each support member 18, 20 and 22 also has an external edge 24 (for member 18); 28 (for member 20) or 32 (for member 22). Support members 18, 20 and 22 of corner reflector 10 may secured to the support members for adjacent corner reflectors along external edges 26 and 30 and 34 as well as internal edges 26, 30 and 34 by stitching (forming the internal and external seams of the inflatable toroidal support structure).

Referring to FIG. 3, when in the proper positioned, as is best illustrated by corner reflector 62 of FIG. 3, the radar reflective surfaces 72, 74 and 76 of reflector 62 form a trihedral section, the apex of which substantially coincides with the apex of reflectors 64, 66 and 68 at the center 90 of the array of corner reflectors which comprise device 60. The center 90 of the array of corner reflectors is open to allow for water drainage and to insure that emergency passive radar locating device 60 remains afloat when locating device 60 is in water.

FIG. 3 also shows two of the three radar reflective surfaces 92 and 94 for corner reflector 64; two of the three radar reflective surfaces 106 and 108 for corner reflector 66 and two of the three radar reflective surfaces 114 and 116 for corner reflector 68. FIG. 3 also the inflatable toroidal support structure or framework for corner reflector 62 comprising quarter circle support members/tubes 78, 80 and 82. In addition, FIG. 3 shows full support structures for corner reflectors 64, 66 and 68. For example, the inflatable support structure for corner reflector 64 includes quarter circle support members 82, 96 and 98, while the inflatable support structure for corner reflector 66 includes quarter circle support members 80, 102 and 104. Likewise the inflatable support structure for corner reflector 68 includes quarter circle support members 78, 110 and 112.

When fully assembled inflatable support members 80, 96, 112 and a fourth support member (not shown) form a first inflatable support ring, inflatable support members 78, 98, 104 and an eighth support member (not shown) form a second inflatable support ring which is perpendicular to the first support ring. Likewise, inflatable support members 82, 102, 110 and a twelfth support member (not shown) form a third inflatable support ring which is perpendicular to the first and second support rings. The three inflatable support rings are connected in the manner shown in FIG. 3, to allow a one way nozzle (not shown) attached to any support member 78, 80, 82, 96, 98, 102, 104, 110 or 112 to be used as a fluid conduit to inflate emergency passive radar locating device 60. The three inflatable support rings also allow for flotation of device 60 when device 60 is deployed in an emergency situation in a water based environment.

In addition, emergency passive radar locating device 60 may easily be adapted to incorporate a pressure vessel or source and a quarter turn valve for rapid inflation and deployment. When deflated and folded, emergency passive radar locating device 60 is compact and light weight requiring minimal space for storage.

Referring now to FIGS. 2, 4, 5 and 6, FIGS. 4, 5 and 6 generally show that emergency passive radar locating device 60 provides for a significant radar cross section at X-band frequencies which allow for easy detection of locating device 60 by search radars on land or at sea.

Figure 2:
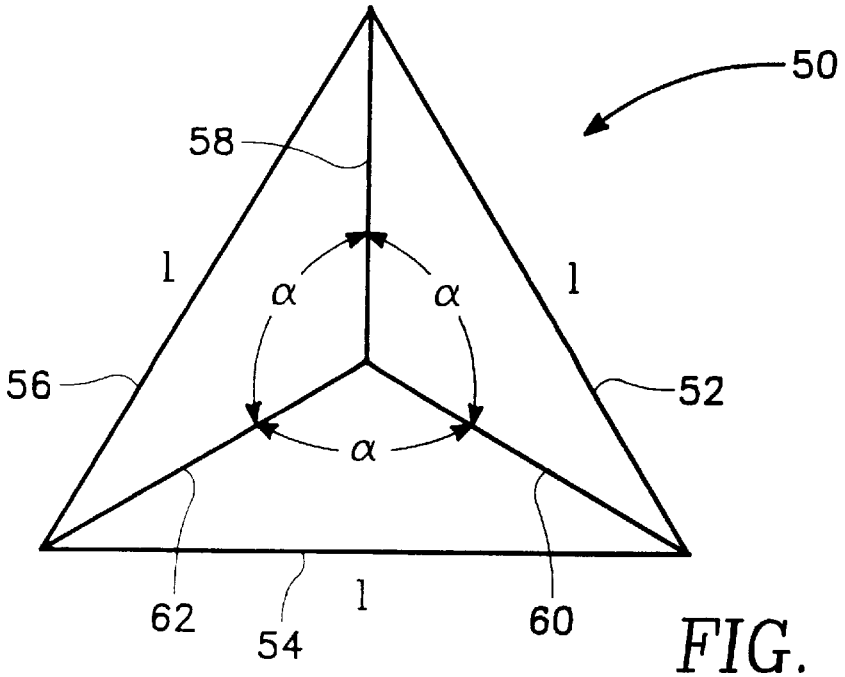
FIG. 2 is an ideal corner reflector diagram for use with the graphics of FIGS. 4, 5 and 6.
Figure 4:
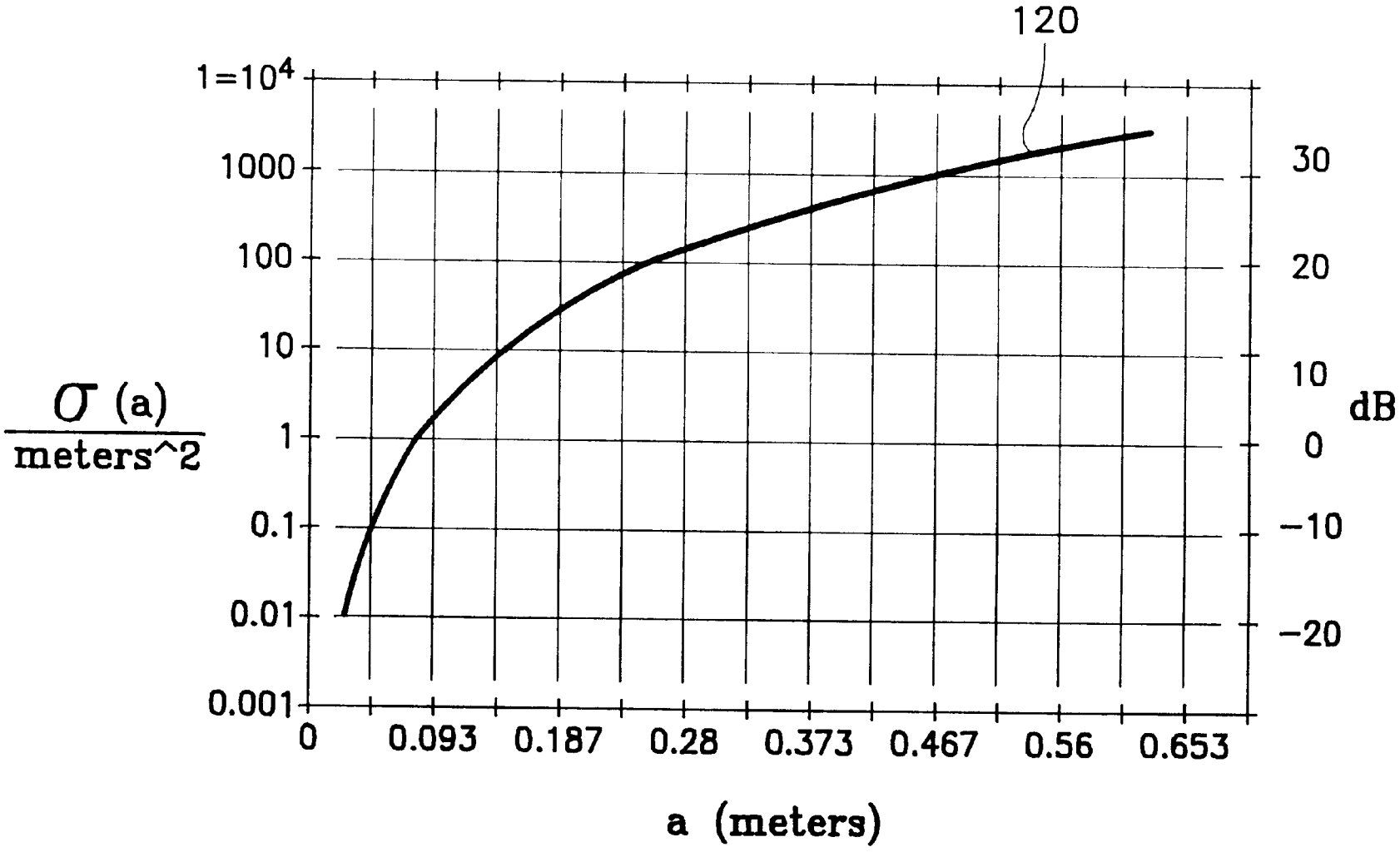
FIG. 4 is a graph illustrating the radar cross section as a function of a trihedral edge for the ideal corner reflector of FIG. 2.

Referring to FIGS. 2 and 4, FIG. 4 compares the radar cross section rendered or generated from an ideal corner 50 (as shown in FIG. 2) when expose to X-band radiation. Curve 120 represents the increase in radar cross section as a function of the length of the side a (as displayed as 1 in FIG. 2) which are sides 52, 54 and 56. For a length (for sides 52, 54 and 56) of 0.125 meters equates to a radar cross section of 10 square meters.

Figure 5:
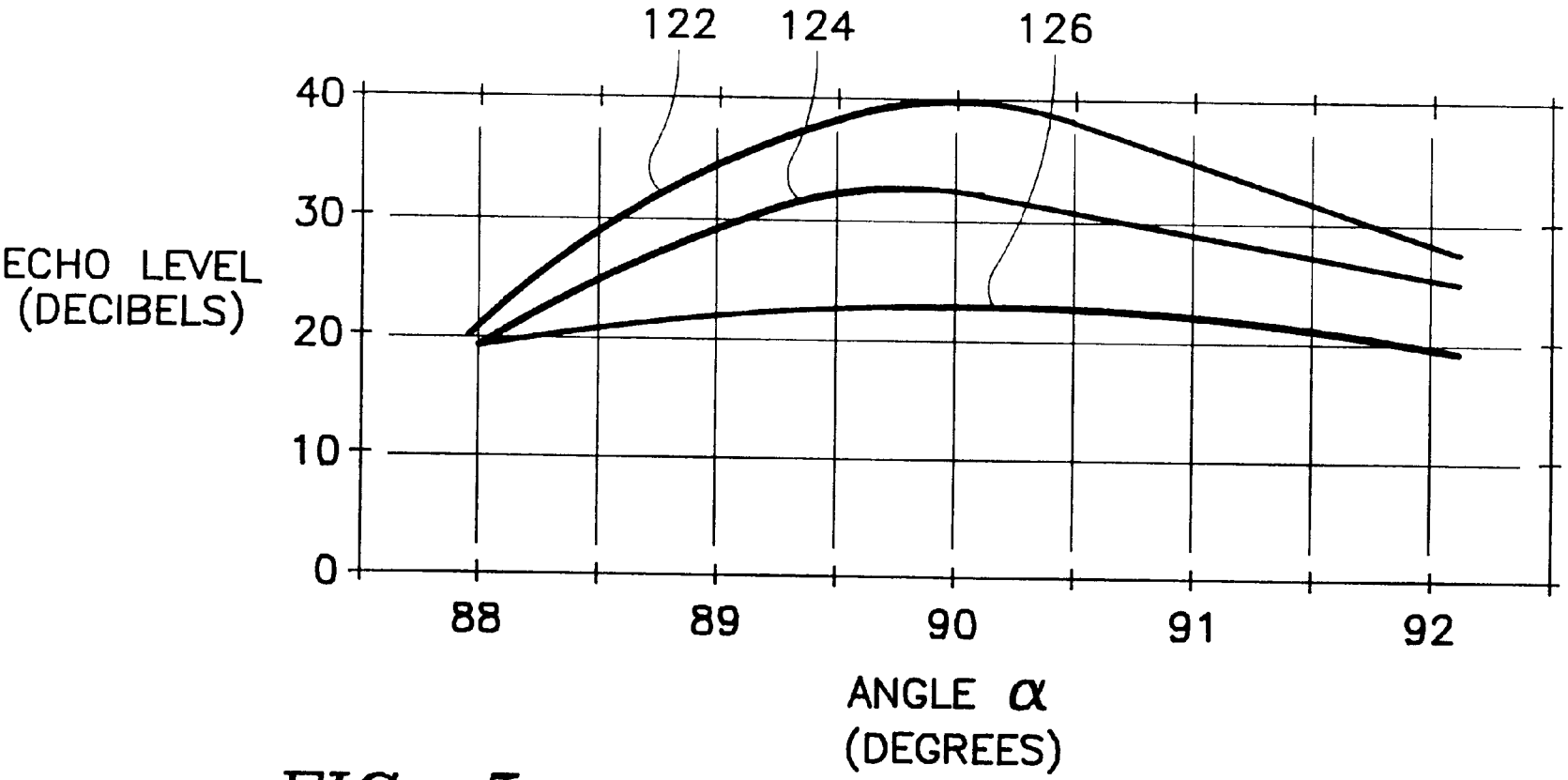
FIGS. 5 and 6 are graphs illustrating radar cross section as a function of trihedral angular deformations for the ideal corner reflector of FIG. 2.

Referring to FIGS. 2 and 5, FIG. 5 uses curves 122, 124 and 126 to show the effect of error in all three corner angles upon the performance of a trihedral corner reflector at a wave length of 1.25 centimeters, where curves 122, 124 and 126 are a function of the length of the side (as displayed as 1 in FIG. 2), at 24, 17 and 9⅜ inches respectively.

Figure 6:
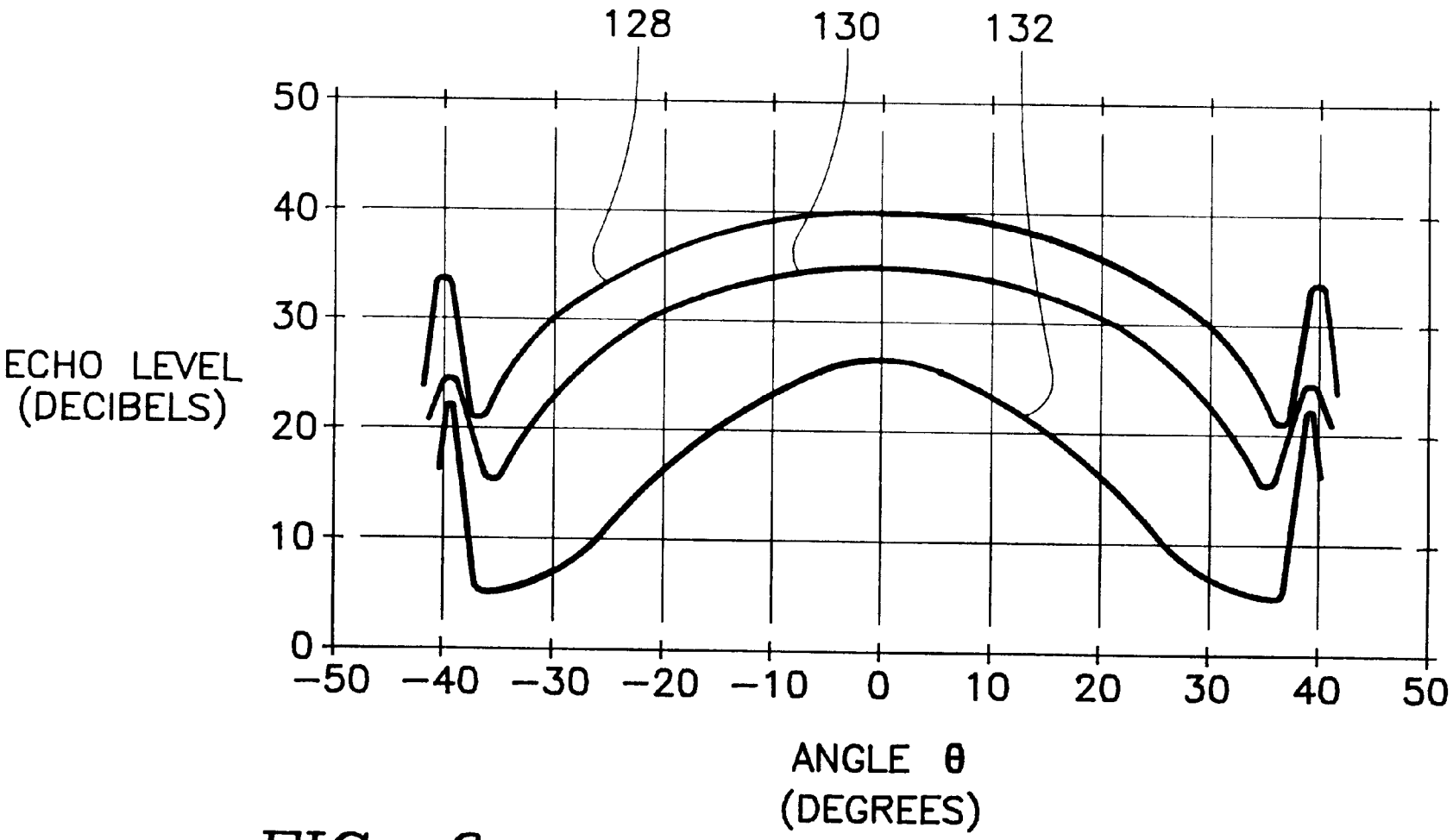

Referring to FIGS. 2 and 6, FIG. 6 uses curves 128, 130, and 132 to show the effect of error in all three corner angles upon the performance of a trihedral corner reflector at a wave length of 1.25 centimeters, where curves 128, 130 and 132 are a function of the angle in degrees (as displayed as $\alpha$ in FIG. 2), at 90, 91 and 92 degrees respectively.

From the foregoing, it may readily be seen that the present invention comprises a new, unique and exceedingly useful emergency passive radar locating device for use in locating missing personnel or craft during a search and rescue operation which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A passive radar locating device comprising:

a collapsible and inflatable permeable radar wave envelope, said collapsible and inflatable permeable radar wave envelope forming a sphere when said envelope is inflated;

a radar reflective array enclosed within said envelope;

said radar reflective array having eight radar wave reflectors which when said envelope is inflated are arranged to form eight trihedral corner reflectors within said envelope;

said radar wave reflectors being fabricated from a flexible material to allow collapsing of said radar reflective array upon collapse of said envelope; and a support structure for supporting each of the trihedral corner reflectors of said radar reflective array when envelope is inflated;

said support structure including first, second and third inflatable floatation rings, said first, second and third inflatable floatation rings being perpendicular to one another, said first, second and third inflatable flotation rings being attached to each of said eight trihedral corner reflectors to support said radar reflective array when said envelope is inflated; and an opening positioned at the center of said radar reflective array to allow for water drainage of said radar reflective array which insures that said passive radar locating device remains afloat when said passive radar locating device is in water based environment.

2. The passive radar locating device of claim 1 wherein each of said eight trihedral corner reflectors has first, second and third radar reflective surfaces which are perpendicular to one another.

3. The passive radar locating device of claim 2 wherein said first, second and third radar reflective surfaces of each of said eight trihedral corner reflectors are fabricated from a light weight, flexible radar reflector material selected from the group consisting of metal impregnated cloth, aluminized mylar, metalized films, laminated foils and metal impregnated rubber compounds.

4. The passive radar locating device of claim 2 wherein each of said first, second and third radar reflective surfaces of each of said eight trihedral corner reflectors has a curved edge which is attached to one of said first, second and third inflatable floatation rings.

5. A passive radar locating device comprising:

a collapsible and inflatable permeable radar wave envelope, said collapsible and inflatable permeable radar wave envelope forming a sphere when said envelope is inflated;

a radar reflective array enclosed within said envelope;

said radar reflective array having eight radar wave reflectors which when said envelope is inflated are arranged to form eight trihedral corner reflectors within said envelope, each of said eight trihedral corner reflectors having first, second and third radar reflective surfaces which are perpendicular to one another;

said radar wave reflectors being fabricated from a flexible material to allow collapsing of said radar reflective array upon collapse of said envelope; and a support structure for supporting each of the trihedral corner reflectors of said radar reflective array when envelope is inflated;

said support structure including first, second and third inflatable floatation rings, said first, second and third inflatable floatation rings being perpendicular to one another, said first, second and third inflatable flotation rings being attached to each of said eight trihedral corner reflectors to support said radar reflective array when said envelope is inflated;

each of said first, second and third radar reflective surfaces of each of said eight trihedral corner reflectors having a curved edge which is attached to one of said first, second and third inflatable floatation rings; and an opening positioned at the center of said radar reflective array to allow for water drainage of said radar reflective array which insures that said passive radar locating device remains afloat when said passive radar locating device is in water based environment.

6. The passive radar locating device of claim 5 wherein said first, second and third radar reflective surfaces of each of said eight trihedral corner reflectors are fabricated from a light weight, flexible radar reflector material selected from the group consisting of metal impregnated cloth, aluminized mylar, metalized films, laminated foils and metal impregnated rubber compounds.

* * * * *